US008207459B2

(12) United States Patent
Bae

(10) Patent No.: US 8,207,459 B2
(45) Date of Patent: Jun. 26, 2012

(54) MOLD CASED CIRCUIT BREAKER

(75) Inventor: Young-Deug Bae, Chungcheongbuk-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 421 days.

(21) Appl. No.: 12/503,326

(22) Filed: Jul. 15, 2009

(65) Prior Publication Data

US 2010/0018846 A1 Jan. 28, 2010

(30) Foreign Application Priority Data

Jul. 25, 2008 (KR) ..... 10-2008-0073156

(51) Int. Cl.
*H01H 1/20* (2006.01)
*H01H 9/20* (2006.01)
*H01H 9/26* (2006.01)

(52) U.S. Cl. ..... 200/50.32; 218/154; 335/8; 335/10; 335/156

(58) Field of Classification Search ..... 200/50.32
See application file for complete search history.

(56) References Cited

U.S. PATENT DOCUMENTS

| | | | | |
|---|---|---|---|---|
| 5,281,776 | A * | 1/1994 | Morel et al. | 218/152 |
| 6,369,340 | B1 | 4/2002 | Castonguay et al. | |
| 2006/0086693 | A1 | 4/2006 | Yeon | |
| 2006/0131145 | A1 | 6/2006 | Suh | |
| 2007/0075808 | A1 | 4/2007 | Ahn | |
| 2008/0157906 | A1 | 7/2008 | Oh | |
| 2008/0246566 | A1 | 10/2008 | Oh | |
| 2009/0039988 | A1 | 2/2009 | Song et al. | |

FOREIGN PATENT DOCUMENTS

| | | |
|---|---|---|
| CN | 1071785 | 5/1993 |
| FR | 2682531 | 4/1993 |
| GB | 2431046 | 4/2007 |

OTHER PUBLICATIONS

China Office action, mail date is Jul. 27, 2011.

* cited by examiner

*Primary Examiner* — Renee Luebke
*Assistant Examiner* — Lheiren Mae Caroc
(74) *Attorney, Agent, or Firm* — Greenblum & Bernstein P.L.C.

(57) ABSTRACT

Disclosed is a mold cased circuit breaker (MCCB) comprising a plurality of single pole breaking units simultaneously opened and closed by a pair of common shaft pins. The MCCB effectively transmits a torque for opening or closing contacts to adjacent single pole breaking unit for electrical pole with a minimized loss, and prevents the shaft pins from being bent. The MCCB comprises a crank installed across the pair of shaft pins so as to connect the shaft pins to each other.

9 Claims, 3 Drawing Sheets

MOLD CASED CIRCUIT BREAKER

RELATED APPLICATION

The present disclosure relates to subject matter contained in priority Korean Application No. 2008-0073156, filed on Jul. 25, 2008, which is herein expressly incorporated by reference in its entirety.

BACKGROUND OF THE INVENTION

1. Field of the Invention

The present invention relates to a mold cased circuit breaker (MCCB), and particularly, to an MCCB having a plurality of single pole breaking units for a plurality of electrical poles, and configured to simultaneously open or close the single pole breaking units by a pair of common shaft pins, the MCCB capable of transmitting a torque for opening or closing contacts to adjacent single pole breaking unit with a minimized loss, and capable of preventing the shaft pins from being bent.

2. Background of the Invention

A mould cased circuit breaker (MCCB) is a low-voltage electrical device that supplies electrical power to a circuit in a normal state, but interrupts the circuit when an abnormal current such as an electric shortage current occurs.

The conventional MCCB comprises single pole breaking unit provided for each of Alternating Current 3 poles of R pole, S pole and T pole (in other words 3 phases), each single pole breaking unit including a movable contactor, fixed contactors, a shaft for rotatably supporting the movable contactor, and an arc extinguishing unit mounted in an insulated case; a pair of shaft pins (shaft driving pins) penetratingly installed at the shafts inside the plurality of single pole breaking units for simultaneously opening or closing the plurality of single pole breaking units; and a switching mechanism including a trip spring, a latch, and links for providing an opening/closing driving force to the shaft pins. Here, the plurality of single pole breaking units, the pair of shaft pins, and the switching mechanism are mounted in a mold case having a lower case and an upper cover. The reason why the single pole breaking units for a plurality of poles configured is in order to minimize the mold cased circuit breaker with the same capacity by ensuring an insulated state among the electrical poles by mounting the single pole breaking units in each insulated case, and by reducing an insulated distance among the poles.

In a mold cased circuit breaker for four poles of R, S, T and N, sequentially and including single pole breaking units, the switching mechanism is installed at the single pole breaking units of 'S' pole. And, a driving force to open or close contacts is directly transmitted to one of the pair of shaft pins, thereby rotating a shaft connected to the shaft pin. Since the other shaft pin is driven to follow the driving shaft pin, a very small difference occurs between rotation moments of the pair of shaft pins. The small difference causes one shaft connected to the shaft pins and disposed in the single pole breaking unit to transmit a rotation force to its adjacent shaft with an eccentric state. Furthermore, the small difference causes the movable contactors and the fixed contactors inside the single pole breaking units to be contacted to or separated from each another with a low reliability.

The difference between rotation moments of the pair of shaft pins is more severe at a part of the pair of shaft pins between the single pole breaking unit for 'S' pole where the switching mechanism is installed, and the single pole breaking unit for 'N' pole farthest from the single pole breaking units for 'S' pole. The large difference causes the shaft pins to be bent. And, the bent state of the shaft pins lowers a reliability to simultaneously open or close the plurality of single pole breaking units of the mold cased circuit breaker.

SUMMARY OF THE INVENTION

Therefore, an object of the present invention is to provide a mold cased circuit breaker (MCCB) that simultaneously drive shafts which move a plurality of movable contactors to an opening position or a closing position by a pair of common shaft pins for a plurality of electrical poles, the MCCB capable of enhancing a reliability to transmit a driving force to open or close contacts between movable contactors and fixed contactors by the one pair of common shaft pins, and capable of preventing the shaft pins from being bent.

To achieve these and other advantages and in accordance with the purpose of the present invention, as embodied and broadly described herein, there is provided a mold cased circuit breaker (MCCB) comprising: a single pole breaking unit for each of a plurality of electrical poles; a plurality of shafts, each disposed in each of the single pole breaking units so as to rotatably support movable contactors; and a pair of shaft pins penetratingly installed at the shafts so as to simultaneously drive the plurality of shafts, the MCCB comprising: a crank installed across the pair of shaft pins so as to connect the shaft pins to each other.

According to another aspect of the present invention, there is provided a mold cased circuit breaker (MCCB) comprising: a plurality of fixed contactors for a plurality of poles; a plurality of movable contactors disposed in correspondence to the fixed contactors, and movable to a closing position contacting the fixed contactors, or an opening position separated from the fixed contactors; a plurality of shafts, each disposed in correspondence to each of the plurality of poles, for rotatably supporting the movable contactors; a switching mechanism connected to the shafts so as to provide a driving force to rotate the shafts; a pair of shaft pins penetratingly installed at the plurality of shafts, for simultaneously moving the movable contactors to a closing position or an opening position; and a crank installed across the pair of shaft pins so as to connect the shaft pins to each other.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

Hereinafter, a mold cased circuit breaker according to the present invention will be explained in more detail.

Figure 1:
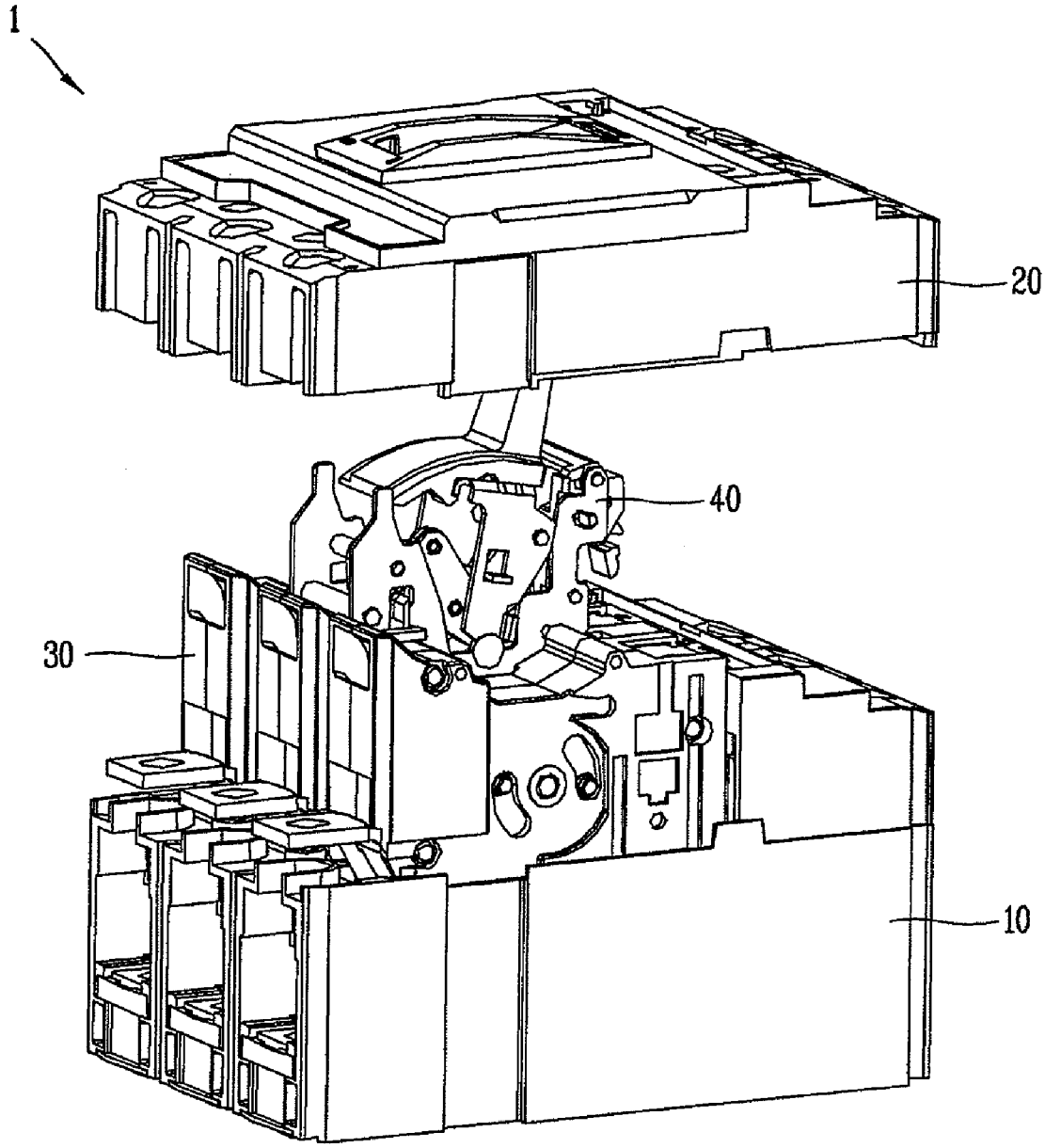
FIG. 1 is an exploded perspective view showing main parts of a mold cased circuit breaker according to the present invention.

Firstly, a main configuration of the mold cased circuit breaker (MCCB) according to the present invention will be explained with reference to FIG. 1.

The mold cased circuit breaker 1 comprises a lower case 10, single pole breaking units 30 (3 single pole breaking units 30 for 3 phases Alternating Current are provided according to a preferred embodiment of the invention) disposed in the lower case 10, a switching mechanism 40, and an upper cover 20 for covering the lower case 10.

The mold cased circuit breaker according to the present invention has a main characteristic in the single pole breaking units 30. Accordingly, configurations and operations of the mold cased circuit breaker will be explained with reference to FIGS. 2 and 3.

Figure 2:
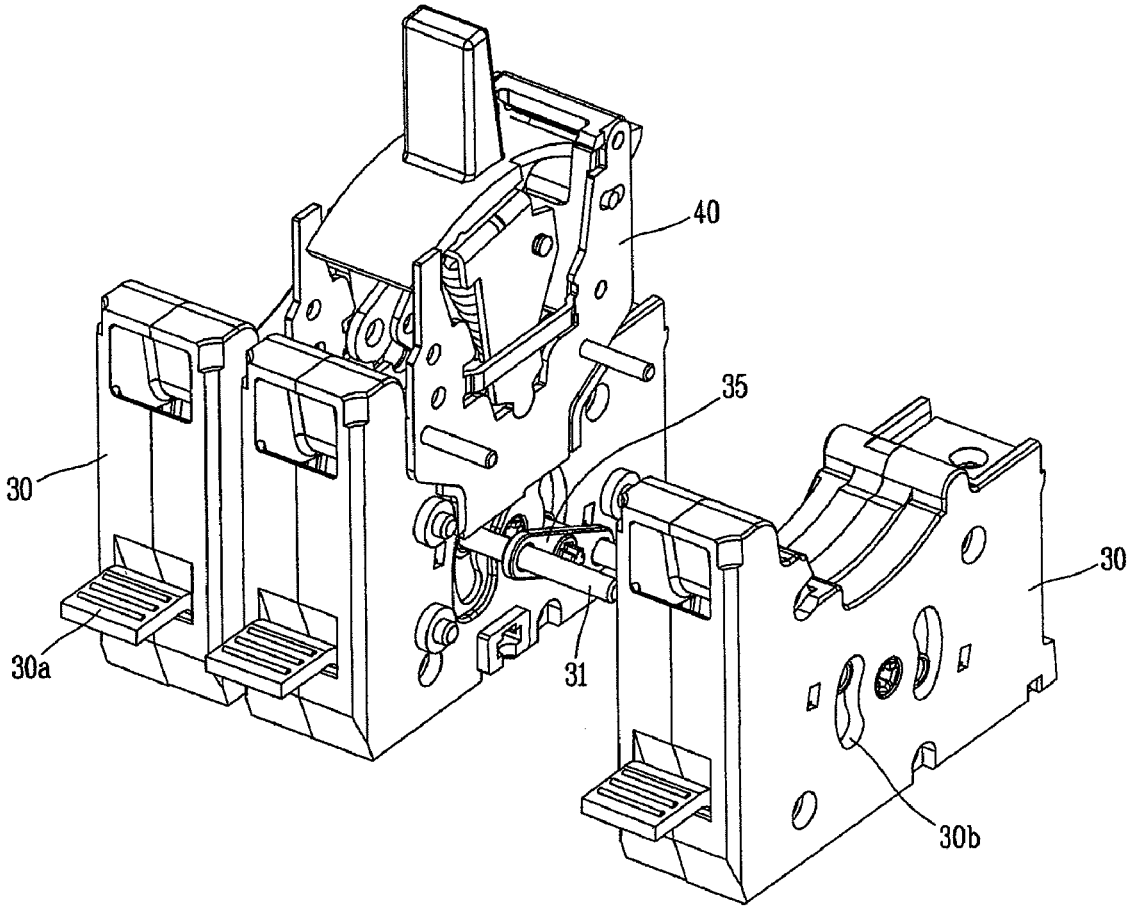
FIG. 2 is a perspective view showing one single pole breaking unit separated from a plurality of single pole breaking units, a switching mechanism, and a crank, which shows an installation state of the crank in the mold cased circuit breaker according to the present invention.
Figure 3:
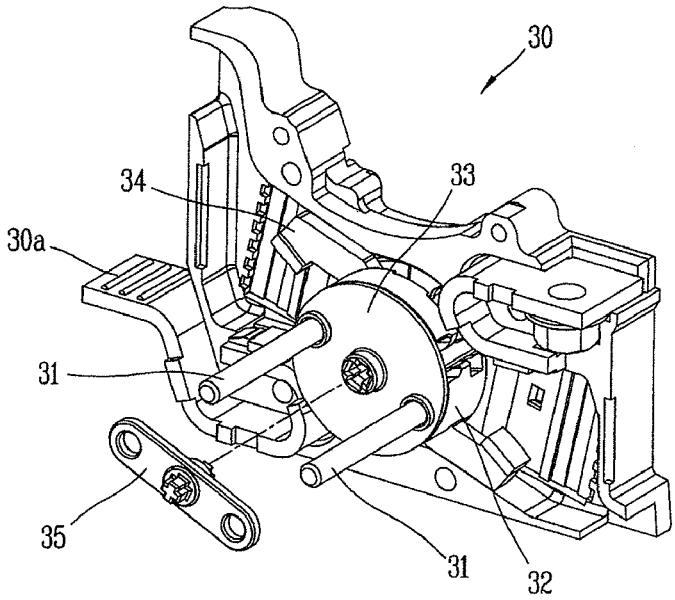
FIG. 3 is a cut perspective view of one single pole breaking unit, which shows a crank separated from a shaft of the mold cased circuit breaker according to the present invention.
Figure 4:
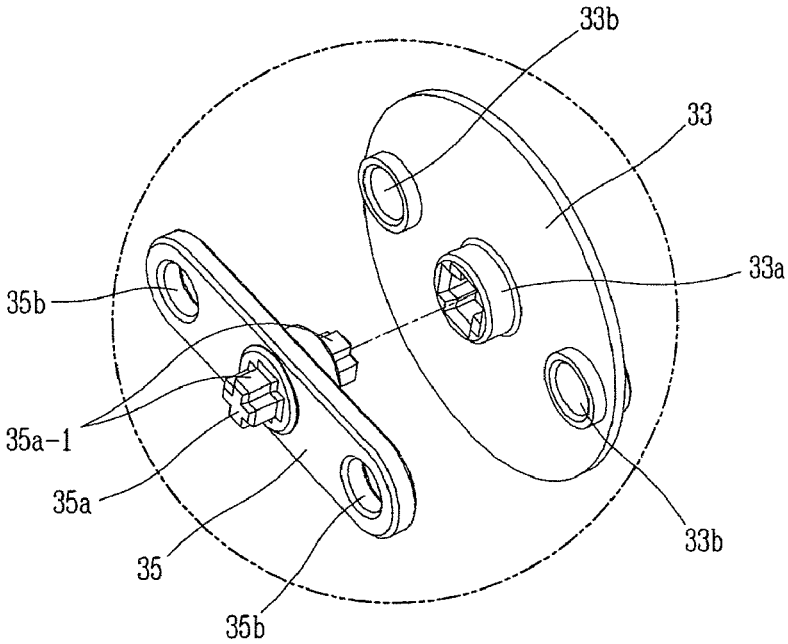
FIG. 4 is an enlarged perspective view showing the crank and a shaft cap.

FIG. 2 is a perspective view showing one single pole breaking unit separated from a plurality of single pole breaking units, a switching mechanism, and a crank, which shows an installation state of the crank in the mold cased circuit breaker according to the present invention, and FIG. 3 is a cut perspective view of one single pole breaking unit, which shows a crank separated from a shaft of the mold cased circuit breaker according to the present invention, where a part indicated by the dotted line is an enlarged perspective view showing the crank and the shaft.

Referring to FIGS. 2 and 3, the MCCB of the present invention comprises single pole breaking units 30, each provided for each of the three-poles(in other words 3 phases) such as R pole, S pole, T pole of AC, shafts 32, each disposed in each of the single pole breaking units 30 and for rotatably supporting movable contactors 34, and one pair of shaft pins 31 penetratingly installed at the plurality of shafts 32 so as to simultaneously drive the shafts 32.

The MCCB of the present invention comprises a plurality of fixed contactors (refer to terminal portions 30*a* of the fixed contactors), each disposed in correspondence to each of a plurality of poles; and a plurality of movable contactors 34 disposed in correspondence to the fixed contactors, and movable to a closing position contacting the fixed contactors, or an opening position separated from the fixed contactors. Each of the shafts 32 is disposed in correspondence to each of the plurality of AC poles such as R, S and T phases, thereby rotatably supporting the movable contactor 34.

Referring to FIG. 2, in the MCCB of the present invention, the switching mechanism 40 is connected to the shaft pins 31 through its lower link (not shown), thereby providing a rotation driving force to the shaft 32 through the shaft pins 31.

Referring to FIG. 3, in the MCCB of the present invention, a pair of shaft pins 31 are penetratingly installed at the plurality of shafts 32 (refer to FIGS. 1 and 2), thereby simultaneously driving the plurality of movable contactors 34 to a closing position or an opening position.

Referring to FIGS. 2 and 3, the MCCB of the present invention comprises a crank 35 installed across the pair of shaft pins 31 so as to connect the shaft pins 31 to each other.

Accordingly, a moment difference between the one pair of shaft pins 31 is minimized, and a loss of an opening/closing driving force transmitted to each of the single pole breaking units is minimized. Accordingly, a bending phenomenon of the shaft pins 31 is minimized.

Since an opening/closing driving force supplied from the switching mechanism 40 is transmitted to the shafts 32 of the single pole breaking units 30 as a maximum torque having a minimized loss, an elastic coefficient of a trip spring (not shown) of the switching mechanism 40 may be minimized. That is, a trip spring having a relatively small elastic force may be used. Accordingly, a mechanic part of the switching mechanism 40 may have an increased durability. Furthermore, since a bent degree of the shaft pins 31 is minimized, a timing difference in the closing operation or opening operation of a plurality of the single pole breaking units 30 is minimized. This may allow electrical power to be stably supplied to an electrical load or cut-off by the MCCB.

Referring to FIG. 2, the crank 35 is installed across at one pair of shaft pins 31 that extend a gap between adjacent one pair of single pole breaking units 30. That is, the crank 35 of FIG. 2 is installed across one pair of shaft pins 31 that extend a gap between shafts (not shown) of adjacent one pair of single pole breaking units 30. More concretely, the crank 35 is installed across the one pair of shaft pins 31 so as to connect the shaft pins 31 to each other. Accordingly, a driving force may be effectively transmitted between adjacent one pair of single pole breaking units 30 by the shaft pins 31 with a minimized loss.

Referring to FIG. 3, the crank 35 is provided with a connecting shaft portion 35*a* connected to the shaft 32 so that a rotation force from the shaft pins 31 can be directly transmitted to the shaft 32. Accordingly, the crank 35 directly transmits an opening/closing driving force due to its rotation to the shaft 32. This enables the shaft 32 to rotate, and thus enhances a reliability in transmitting a driving force between the adjacent single pole breaking units 30.

Referring to FIG. 3, in correspondence to the connecting shaft portion 35*a* of the crank 35, the shaft 32 is provided with a shaft receiving groove portion 33*a* for fitting the connecting shaft portion 35*a* thereinto.

Referring to FIG. 3, the connecting shaft portion 35*a* of the crank 35 is protruding in both of axial directions so as not to limit an assembly direction. Accordingly, the connecting shaft portion 35*a* of the crank 35 can be fitted into the shaft receiving groove portion 33*a* of the shaft 32 in any direction of the both of axial directions. This may enhance an assembly productivity of the crank 35.

Referring to FIG. 3, the crank 35 is installed to pass through the shaft receiving groove portion 33*a*, a central axis of the shaft 32. Accordingly, a rotation driving force is transmitted to the shaft 32 without an eccentric state owing to the crank 35.

Referring to FIG. 3, the connecting shaft portion 35*a* of the crank 35 is provided with at least one teeth 35*a*-1, more concretely, four teeth 35*a*-1. And, the shaft receiving groove portion 33*a* of the shaft 32 has teeth grooves for fitting teeth 35*a*-1 of the connecting shaft portion 35*a* thereinto. Here, the teeth 35*a*-1 of the crank 35 may have various sections such as a square shape, a triangular shape, and an oval shape rather than the cross-shape shown in FIG. 3.

In the present invention, the shaft receiving groove portion 33*a* of the shaft 32 may be disposed at a central part of a shaft cap 33 (a circular member for closing both opened surfaces in an axial direction of the shaft). The shaft cap 33 has one pair of pin holes 33*b* for passing the one pair of shaft pins 31 therethrough.

Preferably, the crank 35 may be configured as a bar-type of thin plate having one pair of pin holes 35*b*.

Hereinafter, an operation to open and close a circuit of the MCCB of the present invention will be explained.

Firstly, an operation to move the movable contactor 34 to a closing position (so called as 'ON' position) will be explained.

Once a handle (not shown) of the switching mechanism 40 is held by a user and rotated to an 'ON' position marked on an upper surface of the upper cover 30 of the MCCB, the shaft pins 31 are counterclockwise rotated by a driving force from the switching mechanism 40. Accordingly, the shafts 32 disposed in the plurality of single pole breaking units 30 and commonly connected to the one pair of shaft pins 31 are also counterclockwise rotated. And, the movable contactors 34 supported by the shafts 32 inside the single pole breaking units 30 for each phase are also counterclockwise rotated. This allows the movable contactors 34 to be contacted to the fixed contactors, thereby completing the closing operation ('ON' position).

Secondly, an operation to move the movable contactor 34 to an opening position ('TRIP' position) will be explained.

Once a trip mechanism (e.g., electromagnet actuator connected to a circuit) performs a trigger operation (an operation to release a latch of the switching mechanism) for a tripping operation, the switching mechanism 40 transmits an opening driving force to rotate the shaft pins 31. Accordingly, the shaft pins 31 are clockwise rotated. As a result, the shafts 32 disposed in the plurality of single pole breaking units 30 and commonly connected to the one pair of shaft pins 31 are also clockwise rotated. And, the movable contactors 34 supported by the shafts 32 inside the single pole breaking units 30 for each phase are also clockwise rotated. This allows the movable contactors 34 to be separated from the fixed contactors, thereby completing the opening operation ('TRIP' position).

The MCCB of the present invention comprises a crank installed across the one pair of shaft pins so as to connect the shaft pins to each other.

Accordingly, a difference between moments of the shaft pins is minimized, and an opening/closing driving force for each phase is transmitted to the adjacent shaft with a minimized loss. And, a bent degree of the shaft pins is minimized.

The MCCB of the present invention comprises the crank installed across the one pair of shaft pins so as to connect the shaft pins to each other.

Accordingly, an opening/closing driving force supplied from the switching mechanism 40 is transmitted to the shafts 32 of the single pole breaking units 30 as a maximum torque having a minimized loss. This may minimize an elastic coefficient of a trip spring (not shown) of the switching mechanism 40. Accordingly, a mechanic part of the switching mechanism 40 may have an increased durability.

Furthermore, the MCCB of the present invention comprises the crank installed across the one pair of shaft pins so as to connect the shaft pins to each other. Accordingly, a bending phenomenon of the shaft pins 31 is minimized, an operation timing difference of the single pole breaking units 30 is minimized. This may allow electrical power to be stably supplied or cut-off by the MCCB.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A mold cased circuit breaker (MCCB) comprising:

a single pole breaking unit for each of electrical poles;

a shaft disposed in each of the single pole breaking units so as to rotatably support a movable contactor; and a pair of shaft pins penetratingly installed at the shafts so as to simultaneously drive the plurality of shafts, the MCCB comprising:

cranks installed across the pair of shaft pins so as to connect the shaft pins to each other, wherein the cranks are provided with connecting shaft portions connected to the shafts so that a rotation force from the shaft pins can be directly transmitted to the shafts, wherein the connecting shaft portions are provided with at least one teeth, and the shafts are provided with shaft receiving groove portions having teeth grooves for fitting the teeth of the connecting shaft portions thereinto.

2. The mold cased circuit breaker of claim 1, wherein the cranks are installed across the pair of shaft pins that extend a gap between two single pole breaking units adjacent to each other.

3. A mold cased circuit breaker (MCCB), comprising:

a plurality of fixed contactors for a plurality of electrical poles;

a plurality of movable contactors disposed in correspondence to the fixed contactors, and movable to a closing position contacting the fixed contactors, or an opening position separated from the fixed contactors;

a plurality of shafts disposed in correspondence to the plurality of poles, for rotatably supporting the movable contactors;

a switching mechanism connected to the shafts so as to provide a driving force to rotate the shafts;

a pair of shaft pins penetratingly installed at the plurality of shafts, for simultaneously moving the movable contactors to a closing position or an opening position; and cranks installed across the pair of shaft pins so as to connect the shaft pins to each other, wherein the cranks are provided with connecting shaft portions connected to the shafts so that a rotation force from the shaft pins can be directly transmitted to shafts, and wherein the shafts are provided with shaft receiving groove portions for fitting the connecting shaft portions thereinto, wherein the connecting shaft portions protrude in axial directions of the cranks.

4. The mold cased circuit breaker of claim 3, wherein the cranks are installed to pass through central axes of the shafts.

5. The mold cased circuit breaker of claim 3, wherein the cranks are installed across the pair of shaft pins that extend a gap between the shafts of adjacent poles.

6. The mold cased circuit breaker of claim 3 , wherein the connecting shaft portions of the cranks are provided with at least one teeth, and the shaft receiving groove portions of the shafts are provided with teeth grooves for fitting the teeth of the connecting shaft portions thereinto.

7. The mold cased circuit breaker of claim 3, wherein the shafts comprise shaft caps having the shaft receiving groove portions at central parts thereof.

8. The mold cased circuit breaker of claim 3, wherein the cranks are configured as thin plates having pin holes for passing the pair of shaft pins therethrough.

9. A mold cased circuit breaker (MCCB) comprising:

a single pole breaking unit for each of electrical poles;

a shaft disposed in each of the single pole breaking units so as to rotatably support a movable contactor; and a pair of shaft pins penetratingly installed at the shafts so as to simultaneously drive the plurality of shafts, the MCCB comprising:

cranks installed across the pair of shaft pins so as to connect the shaft pins to each other; and shaft caps having shaft receiving groove portions for fitting connecting shaft portions of the cranks thereinto.

* * * * *